US006189707B1

(12) United States Patent
Meyers et al.

(10) Patent No.: US 6,189,707 B1
(45) **Date of Patent: *Feb. 20, 2001**

(54) UNIVERSAL SHELF BRACKET FOR REFRIGERATED CASES

(75) Inventors: Thomas A. Meyers, Minnetonka; Peter F. Sosso, Minneapolis, both of MN (US)

(73) Assignee: Stein Industries, Inc., Minneapolis, MN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/951,908

(22) Filed: Oct. 16, 1997

(51) Int. Cl.[7] ..... A47F 5/08

(52) U.S. Cl. ..... 211/90.04; 108/108; 211/90.02; 211/187; 248/248; 248/250

(58) Field of Search ..... 211/90.02, 90.01, 211/90.04, 187, 193, 150, 175, 107, 104, 119.003, 134, 135, 186; 248/250, 247, 248; 108/108, 106, 107, 147.11, 147.17

(56) References Cited

U.S. PATENT DOCUMENTS

| | | | | |
|---|---|---|---|---|
| 1,411,260 | * | 4/1922 | Baker et al. | 108/107 |
| 1,554,011 | * | 9/1925 | Lehman | 108/107 |
| 1,937,935 | * | 12/1933 | Zimmerman | 211/187 X |
| 2,811,260 | * | 10/1957 | Goldstein | 211/135 X |
| 2,940,603 | * | 6/1960 | Riedmaier et al. | 248/250 X |
| 3,009,581 | * | 11/1961 | Stewart | 211/175 |
| 3,041,033 | * | 6/1962 | Schwartz | 248/248 |
| 3,085,693 | * | 4/1963 | Shell | 248/248 |
| 3,765,344 | * | 10/1973 | Ferdinand et al. | 108/108 |
| 3,844,231 | * | 10/1974 | Peacock | 108/107 |
| 4,108,085 | * | 8/1978 | Shepherd et al. | 108/108 |
| 4,518,088 | * | 5/1985 | Passoni | 211/175 X |
| 4,519,508 | * | 5/1985 | Gullett et al. | 211/175 X |
| 4,540,222 | * | 9/1985 | Burrell | 211/187 X |
| 4,603,782 | * | 8/1986 | Fenwick | 211/153 |
| 4,729,613 | * | 3/1988 | Tromble et al. | 211/153 X |
| 4,850,285 | * | 7/1989 | Suttles | 108/108 |
| 4,934,642 | * | 6/1990 | Baron et al. | 211/90.01 X |
| 5,205,421 | * | 4/1993 | Bustos | 108/108 X |
| 5,390,802 | * | 2/1995 | Pappagallo et al. | 211/187 X |
| 5,405,114 | * | 4/1995 | Dias | 248/250 |
| 5,406,894 | * | 4/1995 | Herrmann et al. | 108/108 |
| 5,452,812 | * | 9/1995 | Niequist et al. | 211/187 |
| 5,577,623 | * | 11/1996 | Bustos | 211/187 |
| 5,673,801 | * | 10/1997 | Markson | 211/90.01 X |
| 5,813,741 | * | 9/1998 | Fish et al. | 312/408 |

* cited by examiner

*Primary Examiner*—Daniel P. Stodola
*Assistant Examiner*—Khoa Tran
(74) *Attorney, Agent, or Firm*—Nawrocki, Rooney & Silvertson, P.A.

(57) ABSTRACT

A shelving unit with adjustable brackets for enhanced mounting flexibility in a wide variety of refrigerated display cases. Bracket supports are carried longitudinally by a shelf having opposing ends. The bracket supports have opposing channels positioned at least at the opposing ends of the shelf. A shelf support bracket is provided for slidably engaging the opposing channels of the bracket support and being positioned longitudinally along the shelf corresponding to the spacing of vertical standards affixed within a refrigeration case.

10 Claims, 4 Drawing Sheets

UNIVERSAL SHELF BRACKET FOR REFRIGERATED CASES

FIELD OF INVENTION

This invention relates generally to refrigerated food display cases. More specifically, this invention provides a shelving unit with adjustable brackets for mounting flexibility.

BACKGROUND OF THE INVENTION

Refrigerated display cases are a common feature of modern grocery stores. Typical refrigerated cases have a bottom and four lower sides defining a well, the well serving as a settling area for cool, refrigerated air, and as a display area for food products. Many modern refrigerated cases also have a tall back and top overhang with an open front to allow customers to view, inspect, and retrieve food items.

Competitive pressures have forced grocers to display (and sell) more goods per square foot. However, the costs of replacing functioning units with new units to add additional merchandising shelf space is prohibitive. As an alternative, grocers have installed one or more mezzanine shelves (shelves positioned above the well) in their existing refrigerated display cases in order to increase the amount of horizontal shelf space available in existing refrigerated cases. These refrigerated case conversions increase the utilization of vertical space within the refrigerated cases, and the visual impact of products, particularly through the use of multi-deck mezzanine shelving. Such replacement shelving systems thus provide a viable, cost-effective alternative for grocers needing additional refrigerated shelf space.

Multi-deck shelving case converters may be free standing. Alternatively, one or more shelves may be attached to an existing refrigerated case through a set of vertical, slotted standards provided by the manufacturer of the refrigerated case. New cases utilize similar standards. The several manufacturers of refrigerated cases have their own, varying, specifications for the horizontal spacing intervals between the vertical, slotted standards in their units.

It is the current industry practice for shelf manufacturers to fix mounting brackets to the individual shelves at the specific horizontal spacing interval of the slotted standards of the case in which the shelving is to be installed. As a result of this practice, shelf manufacturers have additional manufacturing complexity, increased inventory and warehousing requirements, and slower turnaround time in servicing customers due to the non-standard nature of the mounting bracket spacing for the shelving units.

SUMMARY OF THE INVENTION

The present invention is a mezzanine shelving unit with adjustable brackets for enhanced mounting flexibility in a wide variety of refrigerated display cases. A device according to the current invention includes a shelf designed to be placed in a standard refrigerated case section.

In a preferred embodiment, two bracket supports are mounted longitudinally along the bottom of a shelf. The bracket supports are mounted parallel to each other, and each support contains a bracket channel, each channel opening toward its counterpart channel on the opposing bracket support. In addition to defining bracket channels, these bracket supports may also provide lateral support to the shelf.

In accordance with the present invention, adjustable brackets are provided which have extending channel tabs located at the ends, the tabs being designed to slide within the provided channels of the bracket supports. Both channel tabs have flat extending segments designed to rest and slide in a corresponding segment of the bracket support. Additionally, at least one of the channel tabs is provided with a flat segment attached, and generally perpendicular, to the end of a flat extending segment, the perpendicular segment serving to slide along a surface or surfaces of the bracket support channel to maintain alignment of the bracket, minimize torsional forces and prevent binding and/or catching as the bracket is slid longitudinally along the bracket supports with the tabs within the channels. Each adjustable bracket also contains two or more integral mounting arms designed to allow attachment of the bracket to a vertical slotted standard provided within the refrigerated case. Each mounting arm may have one or more tab notches which will secure the shelf at least one predetermined angle when the tab slots engage the slotted standards of the refrigerated case. Thus, each adjustable bracket can be positioned precisely within the channels of the bracket support to allow attachment of the adjustable bracket (and the attached shelving unit) to the vertical slotted standard of the refrigerated case, no matter what horizontal distance separates the vertical slotted standards within the case.

DESCRIPTION OF THE PREFERRED EMBODIMENTS

Figure 1:
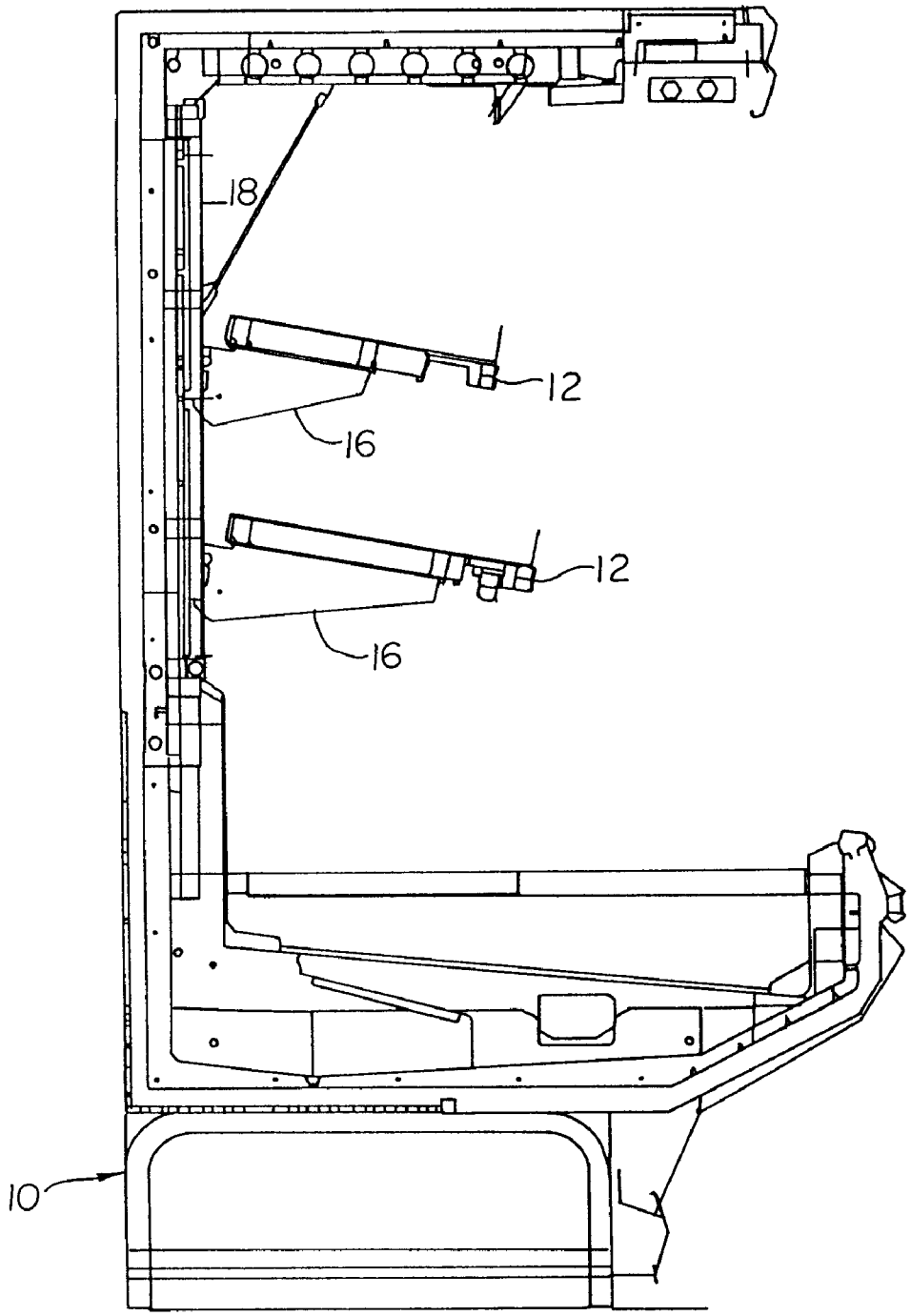
FIG. 1 is a side cross sectional view of a typical refrigerated case having a shelving unit in accordance with the present invention including adjustable brackets mounted to a set of vertical slotted standards contained within the case.

FIG. 1 illustrates a preferred embodiment of the present invention including a refrigerated case 10 having two removable shelving units 12. Each removable shelving unit 12 has two adjustable brackets 16 mounted longitudinally along the bottom of the shelving unit 12.

An adjustable bracket 16 is secured to the shelves by channels 22 (see FIGS. 3 & 4) provided within bracket supports 14, discussed more fully below, such that adjustable bracket 16 can be attached to a vertical slotted standard 18 within the refrigerated case 10, in known manner.

Figure 2:
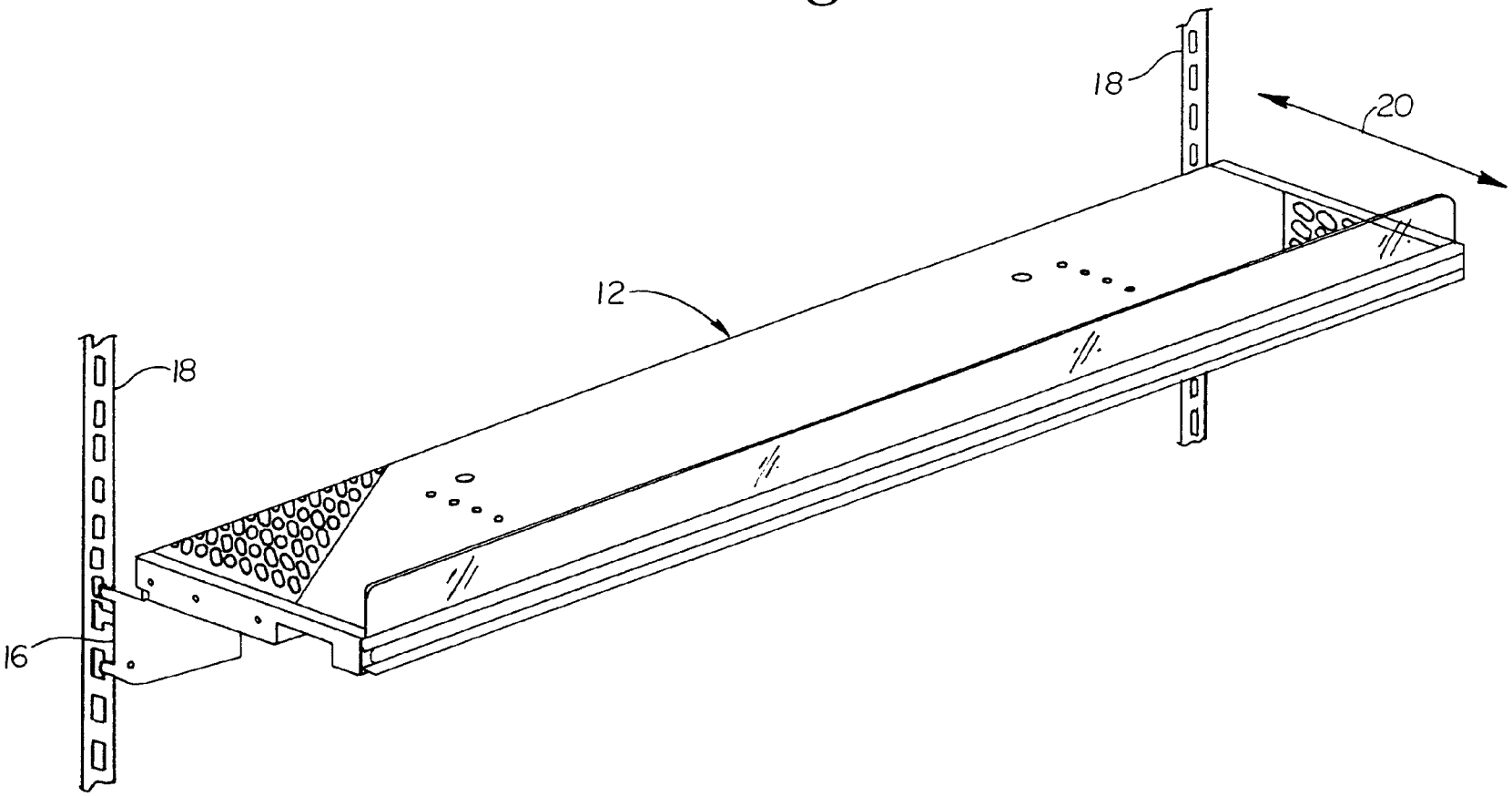
FIG. 2 is a perspective view of a mezzanine shelf with adjustable brackets in accordance with the present invention.

FIG. 2 further illustrates the removable shelving unit 12. In a preferred embodiment of the current invention, the length of the removable shelving unit 12 is designed to be approximately 47.875", such that the shelving unit 12 will mount ideally within a standard four foot refrigerated case section. The width 20 of the removable shelving unit 12 may vary, with preferred embodiments of the removable shelving units 12 having widths 20 of 10", 11.5", 13", 15", 17", 19", 21" and 23".

The bracket channels 22 are separated by a distance ranging from approximately 5" to approximately 16" such that an 5" channel separation distance corresponds to a shelf unit 12 having a width of approximately 10", and a 16" channel separation distance corresponds to a shelf unit 12 having a width of approximately 23".

Figure 3:
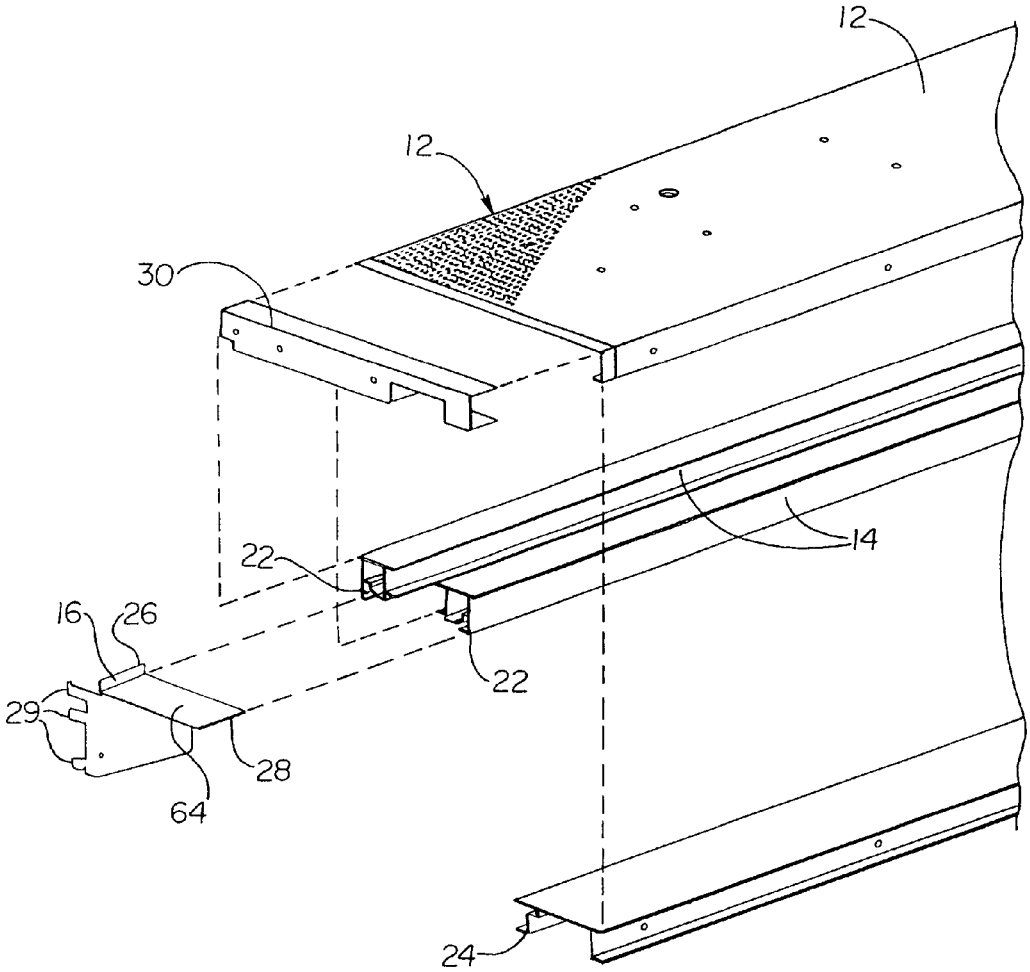
FIG. 3 is an exploded view of the mezzanine shelf with adjustable brackets of FIG. 2.

FIG. 3 is an exploded view of the removable shelving unit 12. In a preferred embodiment, two bracket supports 14 are mounted longitudinally along the bottom of the shelving unit 12. These bracket supports 14 may also serve to provide lateral support to the shelving unit 12. The length of the bracket supports 14 in the illustrated embodiment is approximately 47.68". Each bracket support 14 contains a channel 22 with an opposing slot opening 23 toward its counterpart slot on the parallel opposing bracket support 14. As will be appreciated from the following discussion, when lateral support is not necessary, or is otherwise provided, the bracket supports 14 need extend along the length of the shelving unit 12 only over the desired range of bracket adjustment. An adjustable bracket 16 is provided which contains both an L-shaped channel tab 26 and a flat channel tab 28 positioned at the ends of the adjustable bracket 16.

Figure 4:
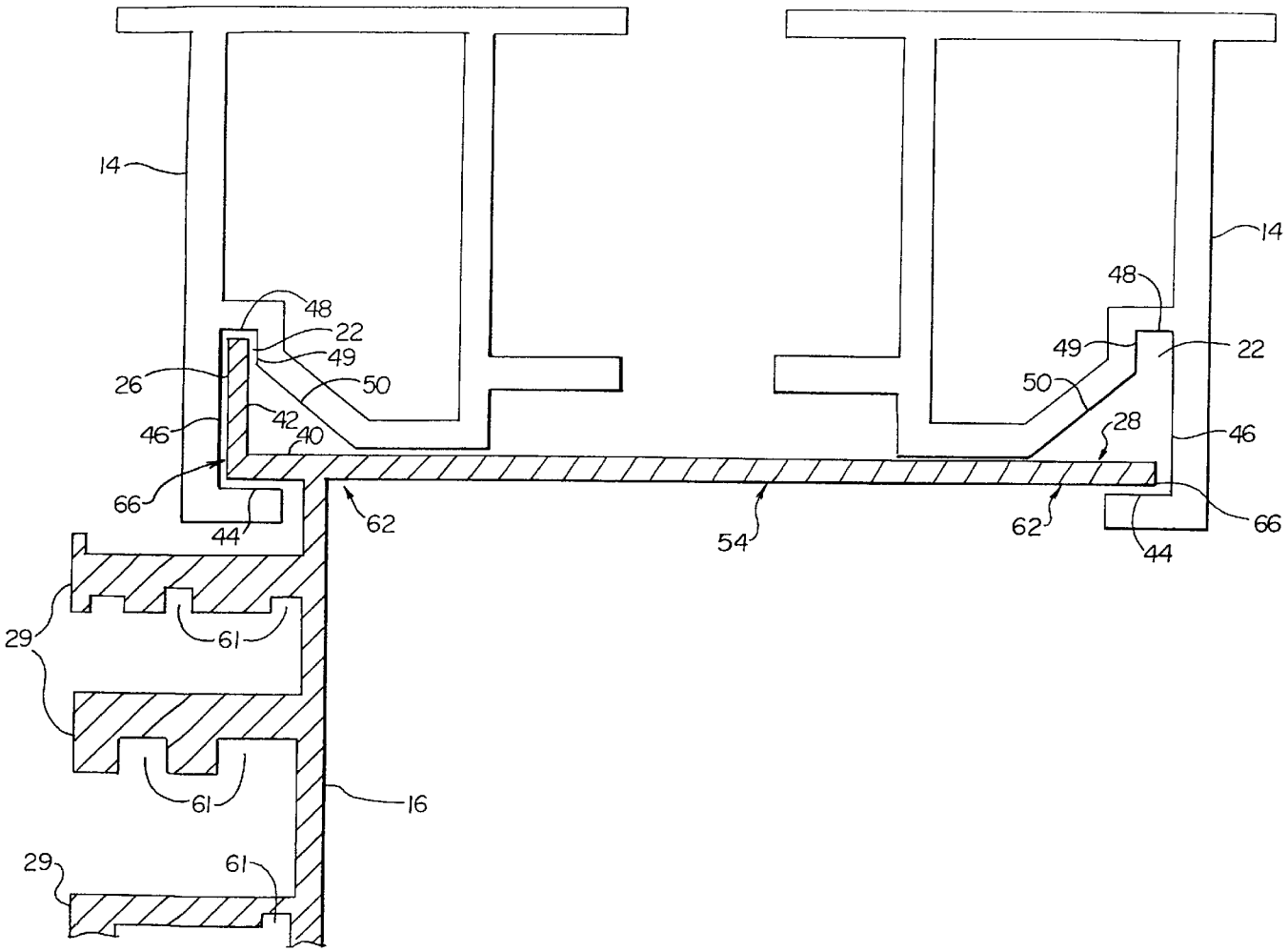
FIG. 4 is a close up view of the end sections of the bracket supports forming a portion of the embodiment of FIGS. 1–3, and the positioning of the bracket tabs within said bracket supports.

As shown in FIGS. 3 & 4, channel tabs 26 & 28 are designed to slide within the provided channels 22 of the bracket supports 14. The bracket supports 14 which form the opposing channels 22 through which the adjustable bracket 16 will slide, are identical, the channels appearing as mirror-images of each other as a result of the orientation of the respective bracket support 14. The area of the channel is defined within the bracket support 14 by a bottom channel support leg 44, a side channel support leg 46, a top channel wall 48, a side channel support wall 49 (generally parallel to leg 46) and an angular side channel support wall 50.

The L-shaped channel tab 26 further comprises an extending tab segment 40 and a perpendicular tab segment 42. The extending tab segment has a proximal end 62 attached to a main body portion 64 of the adjustable bracket. Likewise, the extending tab segment 40 has a distal end 66 projecting away from the main body portion 64 of the adjustable bracket 16. The tab 28 and tab segment 40 are generally parallel. In the illustrated embodiment they are also co-planar.

The tab segment 40 of the L-shaped channel tab 26 will rest and slide within the opening defined by bottom channel support leg 44 of the bracket support 14. The perpendicular tab segment 42 of the L-shaped channel tab 26 will extend at a right angle from the distal end of the tab segment 40 such that the segment 42 will slide along the surfaces formed by leg 46 and wall 49 to maintain the alignment of the tab 26 (and opposing tab 28 within its associated channel) to prevent or reduce binding of the bracket 16 as it is positioned along the bracket supports 14. The flat channel tab 28 will rest and slide within the bottom channel support 44 of the bracket support 14. The adjustable brackets 16 will be positioned within the bracket channels 22 such that the adjustable brackets 16 are set apart in the channels 22 by a distance established by the spacing between the slotted standards 18, which spacing varies from case manufacturer to case manufacturer.

As described above, the adjustable bracket 16 is slidably positioned along the channels 22 of the bracket support 14. The tab segment 40 of the L-shaped channel tab 26 and the flat channel tab 28 will rest and slide on the bottom channel support 44 of the bracket support 14, the bottom channel support 44 providing load bearing support for the adjustable bracket 16. At this same time, the perpendicular tab segment 42 of the L-shaped channel tab 26 will closely align with the side channel support leg 46 and the shortened side channel support wall 49 to provide sliding surfaces perpendicular to the bottom channel support 44 to maintain alignment of the brackets 16 relative to the bracket supports 14 such that torsional forces will be countered as the adjustable bracket slides along the channels 22. Thus, this side channel support will prevent the adjustable bracket 16 from binding or catching in the channels 22 as the adjustable bracket is slid along the channels 22.

Referring back to FIG. 3, each adjustable bracket 16 also contains two or more integral mounting arms 29 to allow attachment of the adjustable bracket 16 to a vertical slotted standard 18 provided within the refrigerated case 10. Each mounting arm 29 will have one or more tab notches 61 formed into the surface of the mounting arm 29 adopted to engage the slotted standard 18 at a predetermined angle, in known manner. In a preferred embodiment, the tab notches 61 on the mounting arms 29 engage the slotted standards 18 such that the shelving unit 12 can have a tilt angle of approximately 0 degrees, 10 degrees or 20 degrees relative to a horizontal reference. In one preferred embodiment, the vertical slotted standard 18 has 0.5" slots positioned longitudinally at a regular interval at a 1" center to center spacing.

Each adjustable bracket 16 can be positioned precisely within the channels 22 of the bracket support 14 to allow attachment of the adjustable bracket 16 (and also the attached shelving unit 12) to the vertical slotted standards 18 of the refrigerated case 10, no matter what horizontal distance (within the adjustment range of the brackets) separates the vertical slotted standards 18 within the case. After the adjustable brackets 16 have been positioned within the channels 22 of the bracket support 14, a shelving unit end cap 30 is fixably attached to each end of the shelving unit 12. This shelf unit end cap 30 will not only provide structural integrity to the shelving unit 12, but will also ensure that the adjustable brackets 16 remain positioned within the channels 22 of the bracket support unit 14.

In a preferred embodiment, a light bracket 24 is also mounted longitudinally to the bottom of the shelving unit 12. This light bracket 24 may serve as a housing within which a light may be mounted, thus providing illumination for shelving units mounted below the illustrated shelving unit 12. This light bracket 24 may also serve to provide lateral support to the shelving unit 12. The light bracket 24 has a length of approximately 47.68".

Numerous characteristics and advantages of the present invention have been set forth in the forgoing description. It will be understood, however, that this disclosure is, in many respects, only illustrative. Changes may be made in details, particularly in matters of shape, size, and arrangement of parts without exceeding the scope of the invention. For example, with the end caps removed, the brackets 16 may be positioned within the channels of the bracket supports 14 with the mounting arms 29 being spaced from each other by a distance greater than the length of the particular shelf. The adjustment range of the brackets 16 is defined by the channels in bracket supports 14. The adjustment range may be the full extent of the bracket support, the full length of the shelf, a lesser amount as desired or a greater amount as indicated. The invention's scope is, therefore, defined in the language in which the appended claims are expressed.

What is claimed is:

1. An adjustable shelf unit adapted for use in a refrigerated case having spaced, slotted standards for supporting at least one shelf, said adjustable shelf unit comprising:

an elongated shelf of fixed dimension having a width and opposing ends;

bracket supports carried longitudinally by said shelf, said bracket supports having spaced channels extending along the length of said shelf and positioned at least at said opposing ends of said shelf; and at least two adjustable shelf support brackets, each of said adjustable support brackets including means for slidably engaging said spaced channels of said bracket supports, said adjustable shelf support brackets being slidably positioned within said channels so as to be selectively adjustable along the length thereof to change the relative spacing therebetween to thereby correspond to a predetermined spacing of standards within a refrigerated case.

2. The adjustable shelf unit as recited in claim 1, wherein said shelf support brackets further comprise opposing channel tabs, each channel tab having a flat segment slidable within said spaced channels of said bracket supports.

3. The adjustable shelf unit as recited in claim 2, wherein at least one of said channel tabs further comprises a perpendicular segment, said perpendicular segment engaging said bracket support to counter torsional forces as said tabs of said shelf support bracket move within said channels.

4. The adjustable shelf unit as recited in claim 3, wherein said shelf support bracket further comprises at least two integral mounting arms, said mounting arms being adapted to engage a slotted standard.

5. The adjustable shelf unit as recited in claim 4, wherein said mounting arms further comprise at least one tab notch.

6. The adjustable shelf unit of claim 3 wherein each of said channels have slots opening toward each other, at least one of said channels further comprising alignment means for engaging said perpendicular segment of one of said channel tabs.

7. The adjustable shelf unit of claim 6 wherein said alignment means comprises surfaces formed within said channel.

8. The adjustable shelf unit of claim 7 wherein said flat segments of said channel tabs are generally parallel, said surfaces of said alignment means being generally perpendicular to said flat segments of said channel tabs once within said channels.

9. The adjustable shelf of claim 2 wherein each of said spaced channels include a bottom channel support, said flat segments of each of said channel tabs being positionable thereupon such that said bottom channel supports provide load bearing support for said shelf support bracket.

10. The adjustable shelf of claim 1 wherein said spaced channels of said bracket supports are spaced from each other by a distance approximately one half the width of said shelf.

* * * * *